US011478838B2

(12) United States Patent
Gambino

(10) Patent No.: US 11,478,838 B2
(45) Date of Patent: Oct. 25, 2022

(54) TUBE BENDING SYSTEMS

(71) Applicant: Rogue Fabrication, LLC, Sandy, OR (US)

(72) Inventor: Joseph Gambino, Sandy, OR (US)

(73) Assignee: Rogue Fabrication, LLC, Sandy, OR (US)

( * ) Notice: Subject to any disclaimer, the term of this patent is extended or adjusted under 35 U.S.C. 154(b) by 34 days.

(21) Appl. No.: 17/105,115

(22) Filed: Nov. 25, 2020

(65) Prior Publication Data

US 2022/0161309 A1 May 26, 2022

(51) Int. Cl.
*B21D 37/18* (2006.01)
*B21D 9/04* (2006.01)

(52) U.S. Cl.
CPC ..... *B21D 37/18* (2013.01); *B21D 9/04* (2013.01)

(58) Field of Classification Search
CPC . B21D 37/18; B21D 9/00; B21D 9/04; B21D 9/07; B21D 9/03; B21D 9/05; B21D 9/073; B21D 7/06
USPC ..... 72/150, 369, 310
See application file for complete search history.

(56) References Cited

U.S. PATENT DOCUMENTS 2,229,096 A * 1/1941 Kocher ..... D04B 35/28 251/355
2,616,524 A * 11/1952 Fox ..... F16N 13/08 417/520
4,380,917 A * 4/1983 Uchida ..... B21D 9/073 72/21.4
4,475,375 A * 10/1984 Hill ..... B21D 9/03 72/466
4,959,984 A * 10/1990 Trudell ..... B21D 7/024 72/154
5,979,204 A * 11/1999 Stange ..... B21D 7/024 72/159
6,155,091 A * 12/2000 Hayes ..... B21D 9/03 403/122
2008/0267698 A1* 10/2008 Rinkenberger ..... B21D 9/03 403/301

FOREIGN PATENT DOCUMENTS

JP 2018202455 A * 12/2018
KR 20180118930 A * 11/2018

* cited by examiner

*Primary Examiner* — Adam J Eiseman
*Assistant Examiner* — P Derek Pressley
(74) *Attorney, Agent, or Firm* — Mohr IP Law Solutions, PC

(57) ABSTRACT

Tube bending systems configured to bend a tube. The tube bending systems include a tube bending device and a lubrication system. The tube bending device includes a bending device frame and a bending die assembly. The tube bending device is configured to bend the tube. The bending die assembly is mounted to the bending device frame and includes a bending die against which the tube is selectively bent. The lubrication system is configured to selectively direct a lubrication fluid to the tube proximate the bending die assembly.

15 Claims, 7 Drawing Sheets

TUBE BENDING SYSTEMS

BACKGROUND

The present disclosure relates generally to tube bending systems. In particular, tube bending systems with lubrication systems are described.

Known tube bending systems are not entirely satisfactory for the range of applications in which they are employed. A key issue with existing tube bending systems is that they are prohibitively expensive for many machine shops. For example, the cost for tube bending systems that can effectively bend stainless steel tubes to wall ratios of 40 to 1 exceed the budgets of most machine shops by a wide margin.

Another limitation of conventional tube bending systems is their tendency to introduce defects when bending tubes. Existing tube bending systems are prone to cause the tube being bent to form wrinkles, deformations, ovalities, and other defects. Defects from conventional tube bending systems are especially pronounced when tight bends are attempted.

Contributing to the defects is a lack of adequate lubrication in known tube bending systems. Inadequate lubrication when bending tubes increases the friction between the tube and the system. Increased friction increases the clamping force needed to hold the tube in position while it is being bent. The increased clamping force on the tube increases defects in the tube by cracking or deforming the tube.

Conventional tube bending systems fail to lubricate all areas of the tube and system that would benefit from lubrication. For example, some lubrication attempts lubricate only the outside of the tube when also lubricating the inside of the tube would be more effective. It would be desirable to have a lubrication system that effectively lubricated both the inside and the outside of a tube as it was being bent.

Thus, there exists a need for tube bending systems that improve upon and advance the design of known tube bending systems. Examples of new and useful tube bending systems relevant to the needs existing in the field are discussed below.

United States patent filings with disclosure relevant to tube bending systems include the following U.S. patent filings identified by either patent number, publication number, or application number: U.S. Pat. Nos. 4,123,930, 4,031,733, 3,922,134, 3,572,083, 3,490,259, 3,279,237, 3,258,956, 5,921,132, 6,463,780, 6,609,405, 6,651,475, 6,883,360, 7,096,707, 7,234,338, 7,360,385, 7,383,716, 8,713,984, 9,144,835, 10,406,580, 4,389,873, 4,638,665, 4,732,025, 4,765,168, and 5,564,303. The complete disclosures of these listed U.S. patent filings are herein incorporated by reference for all purposes.

SUMMARY

The present disclosure is directed to tube bending systems configured to bend a tube. The tube bending systems include a tube bending device and a lubrication system. The tube bending device includes a bending device frame and a bending die assembly. The tube bending device is configured to bend the tube. The tube bending device includes a bending device frame and a bending die assembly. The bending die assembly is mounted to the bending device frame, and the bending die assembly includes a bending die against which the tube is selectively bent. The lubrication system is configured to selectively direct a lubrication fluid to the tube proximate the bending die assembly. In some examples, the tube bending system includes an extension frame.

DETAILED DESCRIPTION

Figure 1:
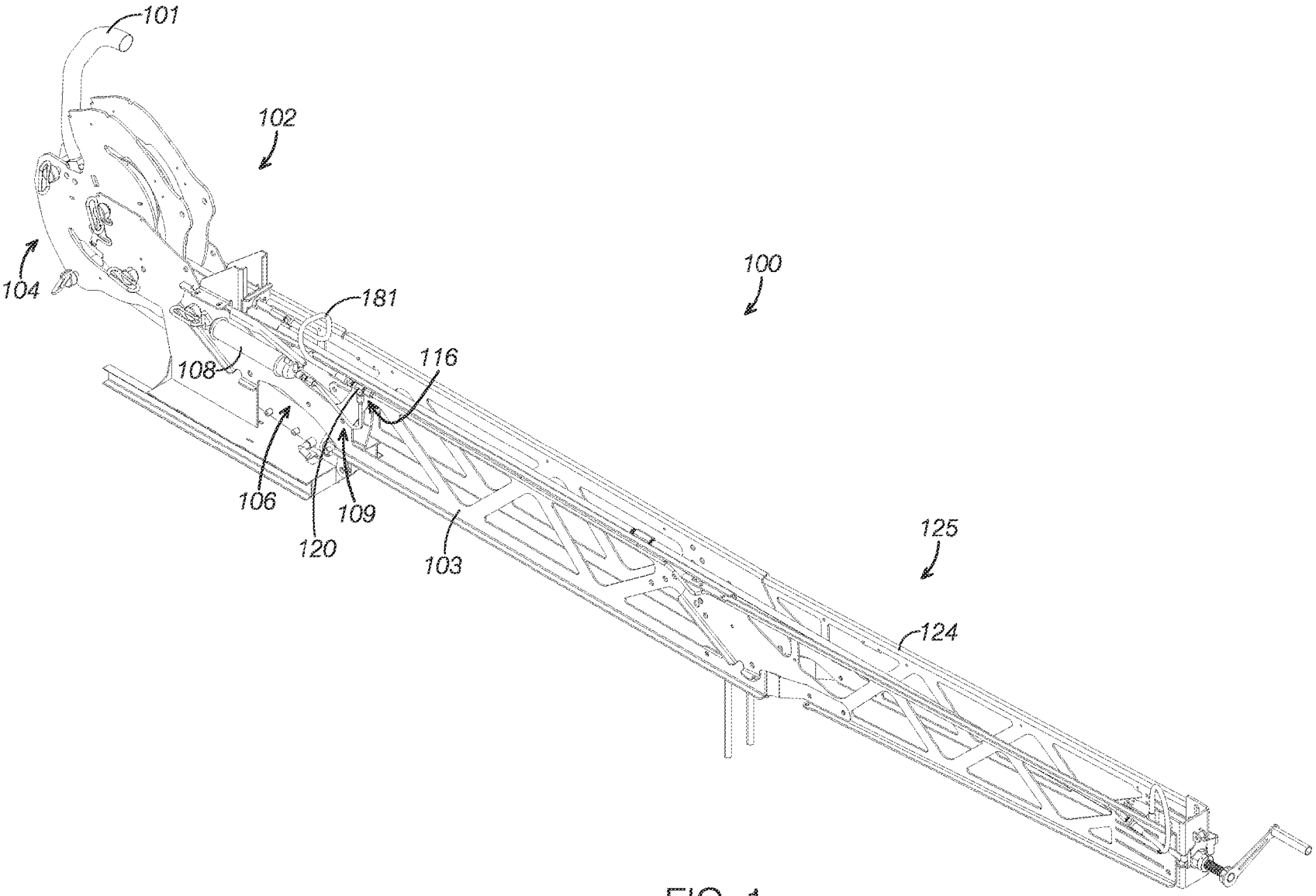
FIG. 1 is a perspective view of a first embodiment of a tube bending system.

The disclosed tube bending systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various tube bending systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

DEFINITIONS

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Tube Bending Systems

With reference to the figures, tube bending systems will now be described. The tube bending systems discussed herein function to bend tubes to defined parameters.

The reader will appreciate from the figures and description below that the presently disclosed tube bending systems address many of the shortcomings of conventional tube bending systems. Of note, the tube bending systems described below are significantly more affordable than conventional tube bending systems with comparable bending performance. For example, the tube bending systems discussed herein can effectively bend stainless steel tubes to wall ratios of 40 to 1 at a cost approximately $1/8^{th}$ the cost of conventional tube bending machines.

The novel tube bending systems below limit defects when bending tubes. The tube bending systems described below are effective to substantially avoid wrinkles, deformations, ovalities, and other defects when used on tubes comprised of common materials. The tube bending systems below are effective to avoid defects even when tight bends are required.

The tube bending systems described herein address the lubrication shortcomings of conventional systems by incorporating lubrication systems. The novel tube bending systems below are effective to reduce the friction between the tube and the system and to reduce the clamping force needed to hold the tube in position while it is being bent. The reduced clamping force on the tube reduces or eliminates cracking or deforming the tube from excessive clamping force.

The tube bending systems discussed herein effectively lubricate all key areas of the tube. For example, the tube bending systems described below effectively lubricated both the inside and the outside of a tube as it is being bent.

Contextual Details

Ancillary features relevant to the tube bending systems described herein will first be described to provide context and to aid the discussion of the tube bending systems.

Tube

Tube 101 is bent to defined parameters by the tube bending systems described below. The tube may be any currently known or later developed type of tube. The reader will appreciate that a variety of tube types exist and could be used in place of the tube shown in the figures. In addition to the types of tubes existing currently, it is contemplated that the tube bending systems described herein could incorporate new types of tubes developed in the future.

The size of the tube may be varied as needed for a given application. In some examples, the tube is larger relative to the other components than depicted in the figures. In other examples, the tube is smaller relative to the other components than depicted in the figures. Further, the reader should understand that the tube and the other components may all be larger or smaller than described herein while maintaining their relative proportions.

The tube may be any of a wide variety of currently known or later developed metals and effectively bent by the tube bending systems described below. Suitable tube materials include carbon steels (1010, 1020, 1026, and 4130 steel), stainless steels, aluminum (6061 and 6063 up to T6 temper), titanium in CWSR (cold worked stress relieved) and annealed condition (2.5AL-3V, CP2, others), as well as copper and its alloys.

Tube Bending System

With reference to FIGS. 1-7, a tube bending system 100 will now be described as a first example of a tube bending system. As shown in FIGS. 1-5, tube bending system 100 functions to bend a tube 101.

The reader can see in FIGS. 1-5 that tube bending system 100 includes a tube bending device 102, a lubrication system 106, and an extension frame 124. In other examples, the tube bending system includes fewer components than depicted in the figures, such as not including an extension frame. In certain examples, the tube bending system includes additional or alternative components than depicted in the figures.

Tube Bending Device

Tube bending device 102 serves to provide the force necessary to bend a tube into a desired shape. In the present example, with reference to FIGS. 1-5, tube bending device 102 is configured to bend tube 101.

As shown in FIGS. 1-7, tube bending device 102 includes a bending device frame 103, a bending die assembly 104, a mandrel 110, and a wiper die assembly 115. In some examples, the tube bending device does not include one or more of a mandrel and a wiper die assembly. In other examples, the tube bending device includes additional or alternative components. The components included in tube bending device 102 are described in more detail in the subsections below.

Bending Die Assembly

Bending die assembly 104 functions to impart bending force on tube 101. With reference to FIGS. 1-5, bending die assembly 104 is mounted to bending device frame 103. Bending die assembly 104 includes a bending die 105 against which tube 101 is selectively bent by a hydraulic ram 180.

The size of the bending die assembly may be varied as needed for a given application. In some examples, the bending die assembly is larger relative to the other components than depicted in the figures. In other examples, the bending die assembly is smaller relative to the other components than depicted in the figures. Further, the reader should understand that the bending die assembly and the other components may all be larger or smaller than described herein while maintaining their relative proportions.

The bending die assembly may be any currently known or later developed type of bending die system. The reader will appreciate that a variety of bending die system types exist and could be used in place of the bending die assembly shown in the figures. In addition to the types of bending die systems existing currently, it is contemplated that the tube bending assemblies described herein could incorporate new types of bending die assemblies developed in the future.

Mandrel

Figure 6:
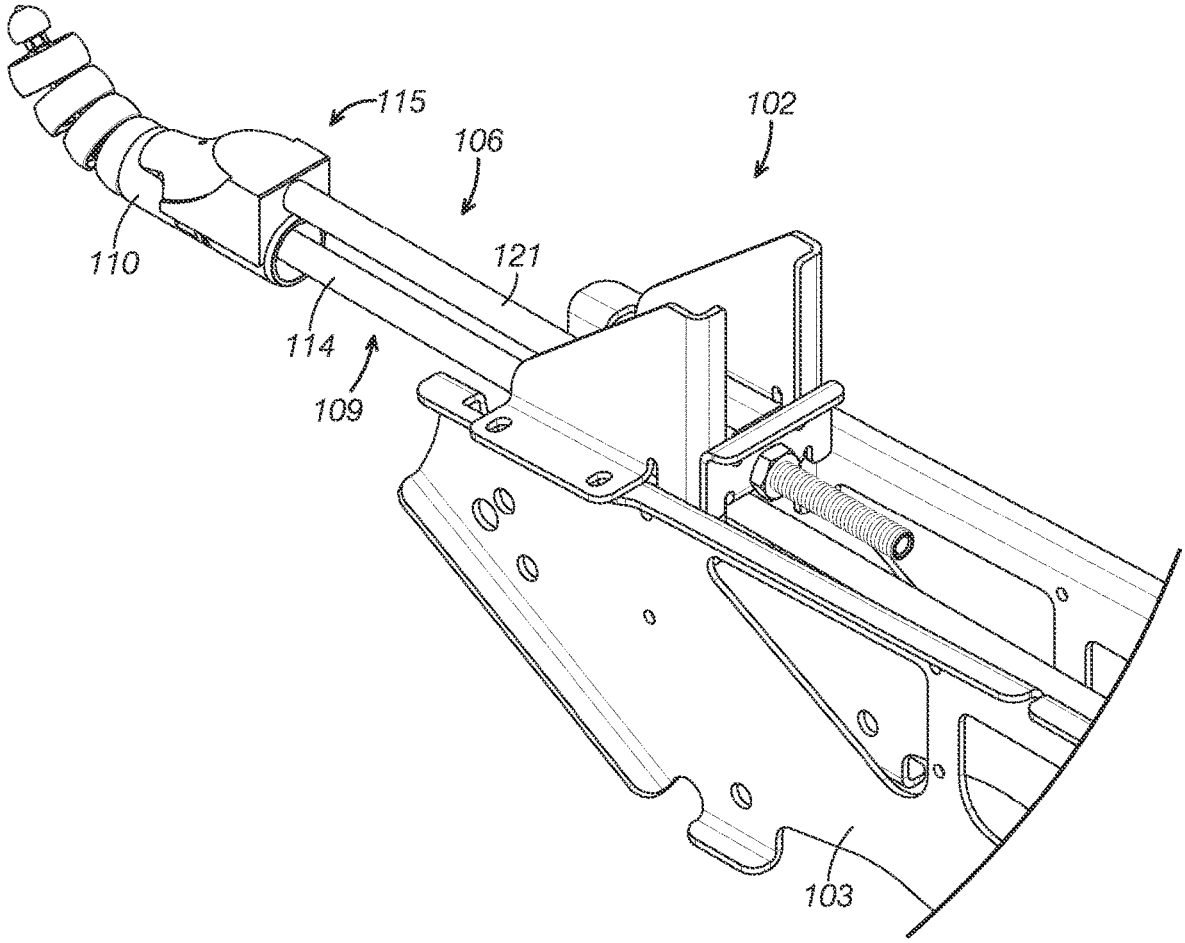
FIG. 6 is a close-up top perspective view of the tube bending system shown in FIG. 1 depicting a wiper die assembly and a mandrel.
Figure 7:
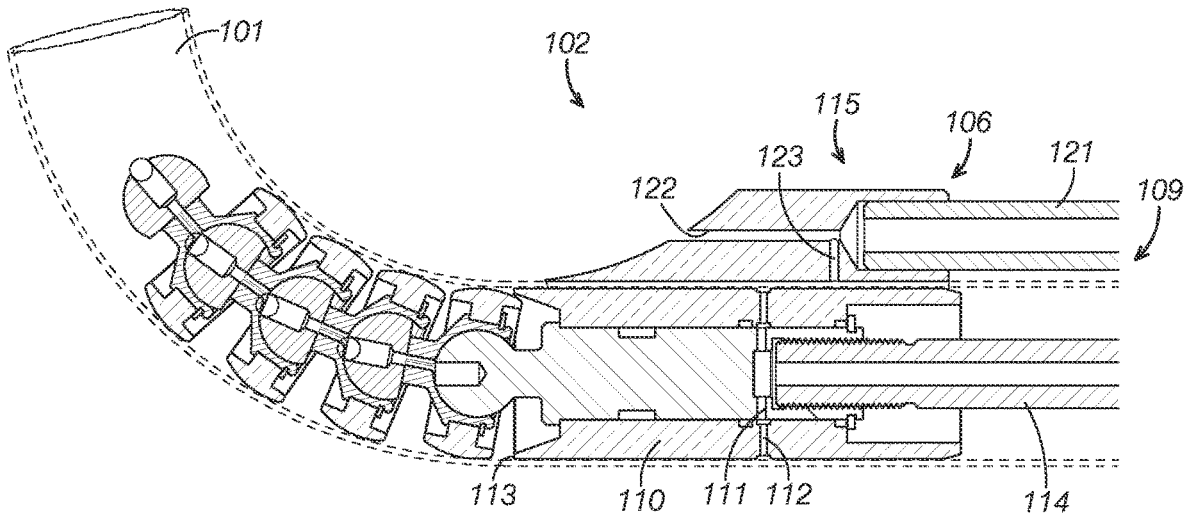
FIG. 7 is a section view of the wiper die assembly and the mandrel shown in FIG. 6 depicting fluid channels formed in the wiper die assembly and the mandrel.

The reader can see in FIGS. 6 and 7 that mandrel 110 is disposed in tube 101 proximate bending die 105. Mandrel 110 functions to support tube 101 from inside tube 101 as tube 101 is being bent by bending die assembly 104. In the present example, mandrel 110 also functions to distribute lubrication fluid inside tube 101.

As depicted in FIGS. 6 and 7, mandrel 110 is mounted to and fluidly coupled to first hollow rod 114. As shown in FIG. 7, mandrel 110 defines a mandrel channel 111 fluidly coupled to distribution system 109 via first hollow rod 114. The reader can see in FIG. 7 that mandrel 110 defines a distribution ring 112 fluidly coupled to mandrel channel 111. Lubrication fluid flows from first hollow rod 114 to mandrel channel 111 through distribution ring 112 to the inside of tube 101.

The size of the mandrel may be varied as needed for a given application. In some examples, the mandrel is larger relative to the other components than depicted in the figures. In other examples, the mandrel is smaller relative to the other components than depicted in the figures. Further, the reader should understand that the mandrel and the other components may all be larger or smaller than described herein while maintaining their relative proportions.

The shape of the mandrel may be adapted to be different than the specific examples shown in the figures to suit a given application. For example, the mandrel may include a face having the shape of a regular or irregular polygon, such as a circle, oval, triangle, square, rectangle pentagon, and the like. Additionally or alternatively, the mandrel may include a face having an irregular shape. In three dimensions, the shape of the mandrel may be a sphere, a pyramid, a cone, a cube, and variations thereof, such as a hemisphere or a frustoconical shape.

The mandrel may be any currently known or later developed type of mandrel. The reader will appreciate that a variety of mandrel types exist and could be used in place of the mandrel shown in the figures. In addition to the types of mandrels existing currently, it is contemplated that the tube bending systems described herein could incorporate new types of mandrels developed in the future.

In the present example, mandrel 110 is comprised in part of bronze. However, the mandrel may be composed of any currently known or later developed material suitable for the applications described herein for which it is used. Suitable materials include metals, polymers, ceramics, wood, and composite materials.

Mandrel Channel

As shown in FIG. 7, mandrel channel 111 is in fluid communication with distribution system 109 and distribution ring 112. Mandrel channel 111 serves to direct lubrication fluid from distribution system 109 to distribution ring 112. From distribution ring 112, lubrication fluid is directed to the inside of tube 101.

The number of mandrel channels defined in the mandrel may be selected to meet the needs of a given application. The reader should understand that the number of mandrel channels may be different in other examples than is shown in the figures. For instance, some tube bending system examples include additional or fewer mandrel channels than described in the present example.

The size of the mandrel channel may be varied as needed for a given application. In some examples, the mandrel channel is larger relative to the other components than depicted in the figures. In other examples, the mandrel channel is smaller relative to the other components than depicted in the figures. Further, the reader should understand that the mandrel channel and the other components may all be larger or smaller than described herein while maintaining their relative proportions.

Distribution Ring

The role of distribution ring 112 is to direct lubrication fluid beyond a leading end 113 of mandrel 110 within tube 101. Distribution ring 112 is in fluid communication with mandrel channel 111 and receives lubrication fluid from mandrel channel 111. The reader can see in FIG. 7 that distribution ring 112 extends around a circumference of mandrel 110 at a position between the longitudinal ends of mandrel 110.

The number of distribution rings defined in the mandrel may be selected to meet the needs of a given application. The reader should understand that the number of distribution rings may be different in other examples than is shown in the figures. For instance, some tube bending system examples include additional or fewer distribution rings than described in the present example.

The size of the distribution ring may be varied as needed for a given application. In some examples, the distribution ring is larger relative to the other components than depicted in the figures. In other examples, the distribution ring is smaller relative to the other components than depicted in the figures. Further, the reader should understand that the distribution ring and the other components may all be larger or smaller than described herein while maintaining their relative proportions.

Wiper Die Assembly

Wiper die assembly 115 functions to support the outside of tube 101 as it is being bent. Supporting the outside of tube 101 reduces wrinkles and other defects forming in tube 101 as it is bent, especially when wiper die assembly 115 and tube 101 are lubricated effectively. In the present example, wiper die assembly also functions to direct lubrication fluid to the outside of tube 101 and to bending die 105.

As depicted in FIGS. 1, 3, 6, and 7, wiper die assembly 115 is mounted to bending device frame 103 proximate bending die assembly 104 and outside of tube 101. As shown in FIGS. 6 and 7, wiper die assembly 115 is coupled to second hollow rod 121 and in fluid communication with second hollow rod 121.

The reader can see in FIG. 7 that wiper die assembly 115 defines a first channel 122 fluidly coupled to distribution system 109. First channel 122 is configured to direct lubrication fluid to bending die 105. As further shown in FIG. 7, wiper die assembly 115 defines a second channel 123 fluidly coupled to distribution system 109. Second channel 123 is configured to direct lubrication fluid to the outside of tube 101.

The wiper die assembly may be any currently known or later developed type of wiper die assembly. The reader will appreciate that a variety of wiper die assemblies exist and could be used in place of the wiper die assembly shown in the figures. In addition to the types of wiper die assemblies existing currently, it is contemplated that the tube bending systems described herein could incorporate new types of wiper die assemblies developed in the future.

The size of the wiper die assembly may be varied as needed for a given application. In some examples, the wiper die assembly is larger relative to the other components than depicted in the figures. In other examples, the wiper die assembly is smaller relative to the other components than depicted in the figures. Further, the reader should understand that the wiper die assembly and the other components may all be larger or smaller than described herein while maintaining their relative proportions.

Bending Device Frame

The role of bending device frame 103 is to support components of bending die assembly, including bending die 105 and hydraulic ram 180. The bending device frame may be any currently known or later developed type of frame. The reader will appreciate that a variety of frame types exist and could be used in place of the frame shown in the figures. In addition to the types of frames existing currently, it is contemplated that the tube bending systems described herein could incorporate new types of frames developed in the future.

In the present example, bending device frame 103 is composed of steel. However, the bending device frame may be composed of any currently known or later developed material suitable for the applications described herein for which it is used. Suitable materials include metals, polymers, ceramics, wood, and composite materials.

The size of the bending device frame may be varied as needed for a given application. In some examples, the bending device frame is larger relative to the other components than depicted in the figures. In other examples, the bending device frame is smaller relative to the other components than depicted in the figures. Further, the reader should understand that the bending device frame and the other components may all be larger or smaller than described herein while maintaining their relative proportions.

Bending Die

Bending die 105 cooperates with hydraulic ram 180 to bend tube 101. The curved shape of bending die 105 is configured to impart bends into tube 101 when hydraulic ram 180 presses tube 101 against bending die 105.

The size of the bending die may be varied as needed for a given application. In some examples, the bending die is larger relative to the other components than depicted in the figures. In other examples, the bending die is smaller relative to the other components than depicted in the figures. Further, the reader should understand that the bending die and the other components may all be larger or smaller than described herein while maintaining their relative proportions.

The bending die may be any currently known or later developed type of bending die. The reader will appreciate that a variety of bending die types exist and could be used in place of the bending die shown in the figures. In addition to the types of bending dies existing currently, it is contemplated that the tube bending systems described herein could incorporate new types of bending dies developed in the future.

Lubrication System

The role of lubrication system 106 is to lubricate tube 101, inside and out, to reduce friction between tube 101 and mandrel 110, wiper die assembly 115, and bending die assembly 104. By reducing friction between tube 101 and components of system 100, lubrication system 106 reduces or eliminates many defects that would otherwise arise during the bending process.

With reference to FIGS. 1-5, the reader can see that lubrication system 106 is configured to selectively direct a lubrication fluid to tube 101 proximate bending die assembly 104 via first channel 122 defined in wiper die assembly 115.

Figure 2:
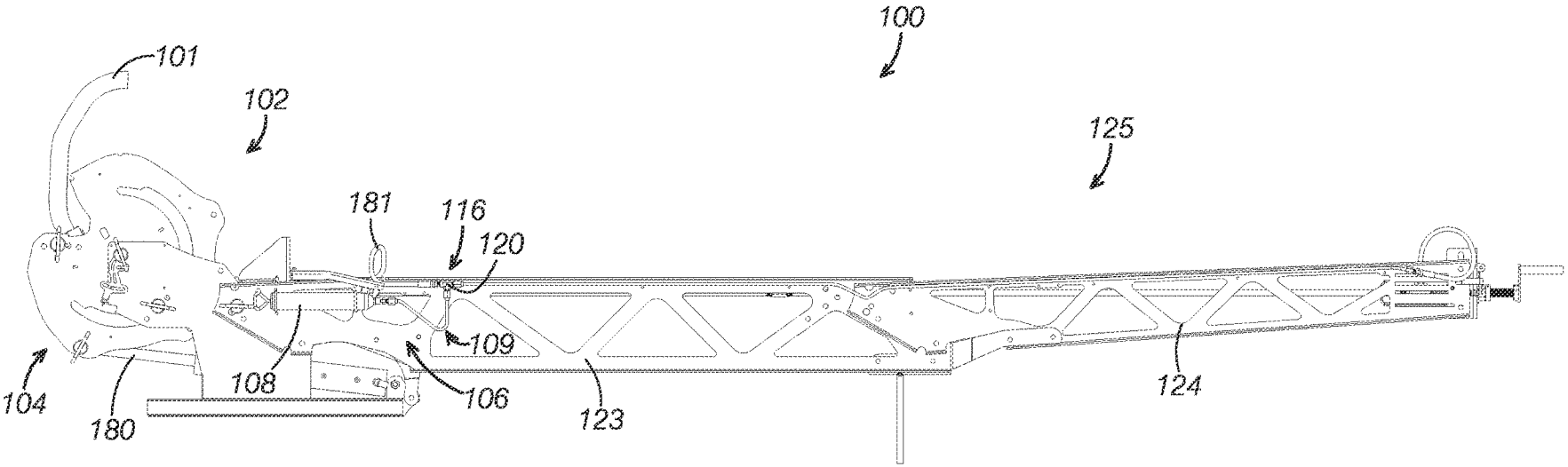
FIG. 2 is a side elevation view of the tube bending system shown in in FIG. 1.

As shown in FIG. 2, lubrication system 106 includes a pump 108 and a distribution system 109. The components of lubrication system 106 are explained further in the subsections below.

Pump

As depicted in FIG. 2, pump 108 is configured to pressurize lubrication fluid to direct it through lubrication system 106. In particular, pump 108 pressurizes lubrication fluid to direct it initially through distribution system 109.

Figure 3:
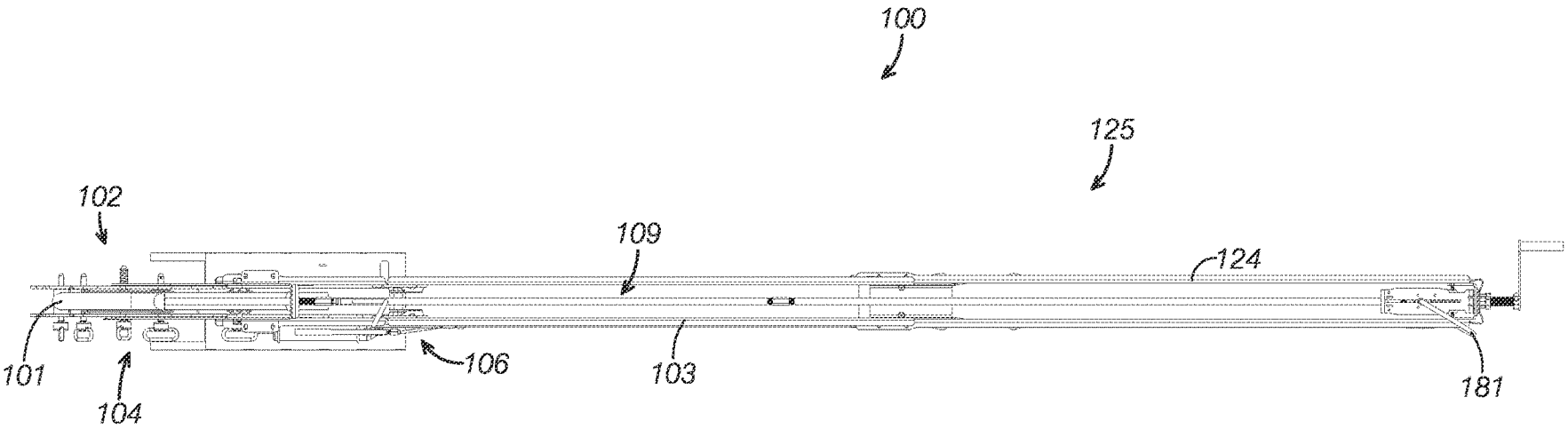
FIG. 3 is a top plan view of the tube bending system shown in FIG. 1.
Figure 4:
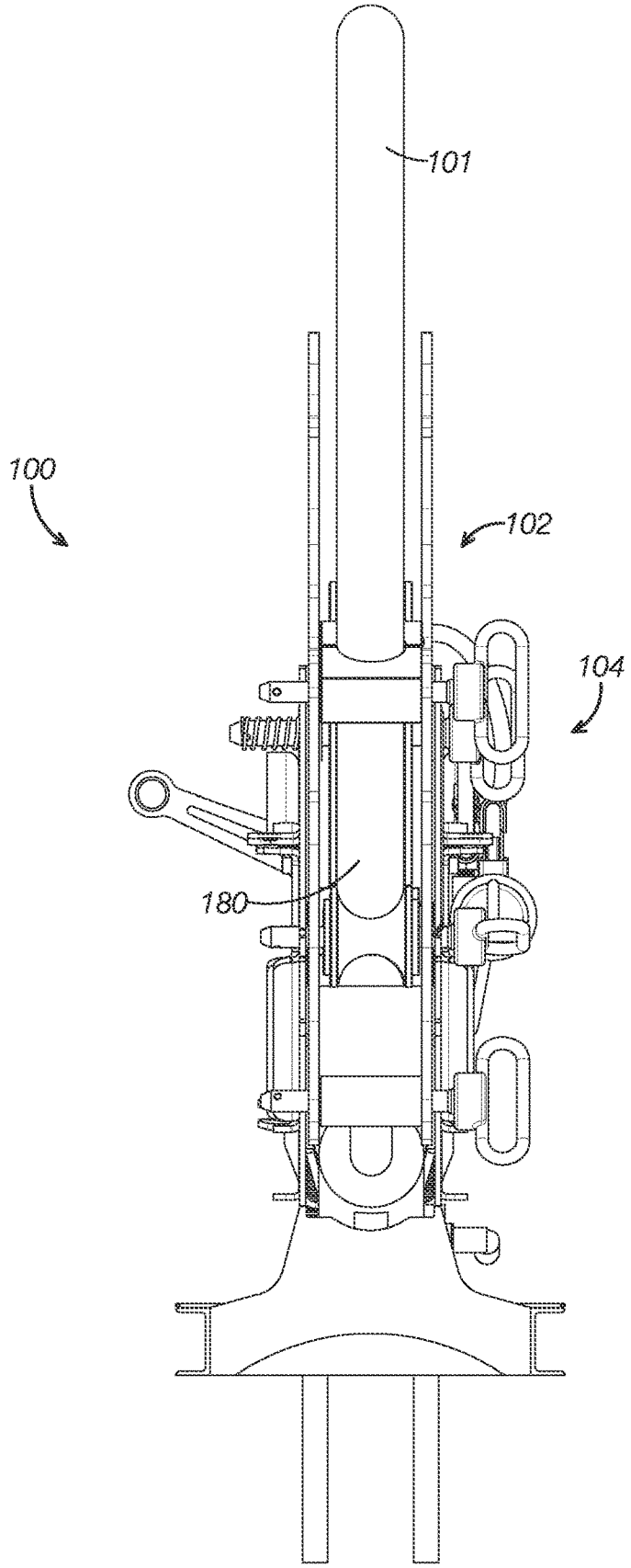
FIG. 4 is a front end view of the tube bending system shown in FIG. 1.
Figure 5:
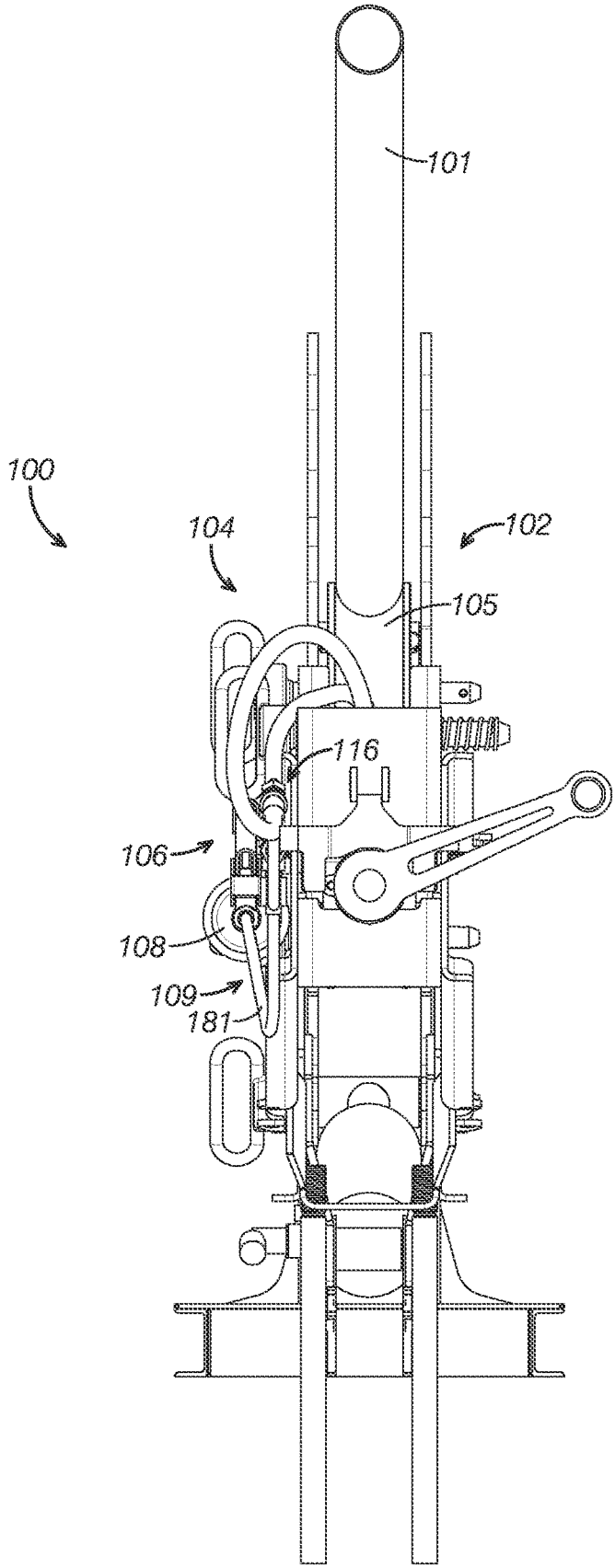
FIG. 5 is a rear end view of the tube bending system shown in FIG. 1.

With reference to FIGS. 1-3, pump 108 is hand operated in the present example. However, the pump may be any currently known or later developed type of pump. The reader will appreciate that a variety of pump types exist and could be used in place of the pump shown in the figures. In addition to the types of pumps existing currently, it is contemplated that the tube bending systems described herein could incorporate new types of pumps developed in the future.

The size of the pump may be varied as needed for a given application. In some examples, the pump is larger relative to the other components than depicted in the figures. In other examples, the pump is smaller relative to the other components than depicted in the figures. Further, the reader should understand that the pump and the other components may all be larger or smaller than described herein while maintaining their relative proportions.

The number of pumps in the tube bending system may be selected to meet the needs of a given application. The reader should understand that the number of pumps may be different in other examples than is shown in the figures. For instance, some tube bending system examples include additional or fewer pumps than described in the present example.

Distribution System

The role of distribution system 109 is to distribute lubrication fluid throughout lubrication system 106. As shown in FIGS. 2 and 7, distribution system 109 is fluidly coupled to pump 108, wiper die assembly 115, and mandrel 110.

The reader can see in FIGS. 1-3, 6, and 7 that distribution system 109 includes fluid tubing 181, a fluid line junction 116, a flow control device 120, a first hollow rod 114, and a second hollow rod 121.

The distribution system may be any currently known or later developed type of distribution system. The reader will appreciate that a variety of distribution system types exist and could be used in place of the distribution system shown in the figures. In addition to the types of distribution systems existing currently, it is contemplated that the tube bending systems described herein could incorporate new types of distribution systems developed in the future.

The size of the distribution system may be varied as needed for a given application. In some examples, the distribution system is larger relative to the other components than depicted in the figures. In other examples, the distribution system is smaller relative to the other components than depicted in the figures. Further, the reader should understand that the distribution system and the other components may all be larger or smaller than described herein while maintaining their relative proportions.

Fluid Line Junction

With reference to FIGS. 1 and 2, the reader can see that fluid line junction 116 is fluidly coupled to pump 108, mandrel 110, and wiper die assembly 115 via fluid tubing 181, first hollow rod 114, and second hollow rod 121. As further depicted in FIGS. 1 and 2, fluid line junction 116 divides a supply of lubrication fluid from pump 108 into a mandrel stream directed to mandrel 110 and a wiper die stream directed to wiper die assembly 115. As depicted in FIG. 7, lubrication fluid in the mandrel stream moves through first hollow rod 114 to mandrel 110 and lubrication fluid in the wiper die stream moves through second hollow rod 121 to wiper die assembly 115.

Flow Control Device

Flow control device 120 selectively restricts the supply of lubrication fluid into one or more of a mandrel stream and a wiper die stream. As shown in FIGS. 1 and 2, flow control device 120 is operatively connected to fluid line junction 116.

The size of the flow control device may be varied as needed for a given application. In some examples, the flow control device is larger relative to the other components than depicted in the figures. In other examples, the flow control device is smaller relative to the other components than depicted in the figures. Further, the reader should understand that the flow control device and the other components may all be larger or smaller than described herein while maintaining their relative proportions.

In the present example, flow control device 120 is a ball valve. However, the flow control device may be any currently known or later developed type of flow control device. The reader will appreciate that a variety of flow control device types exist and could be used in place of the flow control device shown in the figures. In addition to the types of flow control devices existing currently, it is contemplated that the tube bending systems described herein could incorporate new types of flow control devices developed in the future.

Lubrication Fluid

The lubrication fluid functions to lubricate the interfaces between tube 101 and the components of system 100 both inside and outside of tube 101.

In the present example, the lubrication fluid is formulated to limit oxidation of bronze and is a synthetic gel. However, the lubrication fluid may be any currently known or later developed type of lubrication fluid. The reader will appreciate that a variety of lubrication fluid types exist and could be used in place of the lubrication fluid shown in the figures. In addition to the types of lubrication fluids existing currently, it is contemplated that the tube bending systems described herein could incorporate new types of lubrication fluids developed in the future.

Extension Frame

The role of extension frame 124 is to support components spaced from bending die assembly 104. With reference to FIGS. 1-3, extension frame 124 is configured to selectively couple to bending device frame 103 distal bending die assembly 104. Bending device frame 103 and extension frame 124 collectively define an elongated frame 125.

The extension frame may be any currently known or later developed type of frame. The reader will appreciate that a variety of frame types exist and could be used in place of the extension frame shown in the figures. In addition to the types of frames existing currently, it is contemplated that the tube bending systems described herein could incorporate new types of extension frames developed in the future.

The size of the extension frame may be varied as needed for a given application. In some examples, the extension frame is larger relative to the other components than depicted in the figures. In other examples, the extension frame is smaller relative to the other components than depicted in the figures. Further, the reader should understand that the extension frame and the other components may all be larger or smaller than described herein while maintaining their relative proportions.

In the present example, extension frame 124 is composed of steel. However, the extension frame may be composed of any currently known or later developed material suitable for the applications described herein for which it is used. Suitable materials include metals, polymers, ceramics, wood, and composite materials.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A tube bending system for bending a tube, comprising: a tube bending device configured to bend the tube, the tube bending device including:

a bending device frame; and a bending die assembly mounted to the bending device frame, the bending die assembly including a bending die against which the tube is selectively bent;

a lubrication system configured to selectively direct a lubrication fluid to the tube proximate the bending die assembly, the lubrication system including:

a pump configured to pressurize the lubrication fluid; and a distribution system fluidly coupled to the pump; and a wiper die assembly mounted to the bending device frame proximate the bending die assembly and outside the tube, the wiper die assembly defining a first channel fluidly coupled to the distribution system and configured to direct the lubrication fluid directly to the bending die.

2. The tube bending system of claim 1, wherein:

the tube bending device includes a mandrel disposed in the tube proximate the bending die; and the mandrel defines a mandrel channel fluidly coupled to the distribution system.

3. The tube bending system of claim 2, wherein the mandrel defines a distribution ring fluidly coupled to the mandrel channel.

4. The tube bending system of claim 3, wherein the distribution ring is configured to direct lubrication fluid within the tube beyond a leading end of the mandrel.

5. The tube bending system of claim 3, wherein the distribution ring extends around a circumference of the mandrel at position between longitudinal ends of the mandrel.

6. The tube bending system of claim 3, wherein:

the distribution system includes a first hollow rod;

the mandrel is mounted to the first hollow rod; and the lubrication fluid moves through the first hollow rod to the mandrel.

7. The tube bending system of claim 1, wherein the pump is hand operated.

8. The tube bending system of claim 2, wherein the distribution system includes a fluid line junction fluidly coupled to the pump, the mandrel, and the wiper die assembly.

9. The tube bending system of claim 8, wherein the fluid line junction divides a supply of lubrication fluid from the pump into a mandrel stream directed to the mandrel and a wiper die stream directed to the die assembly.

10. The tube bending system of claim 9, wherein the distribution system includes a flow control device operatively connected to the fluid line junction to selectively restrict the supply of lubrication fluid into one or more of the mandrel stream and the wiper die stream.

11. The tube bending system of claim 9, wherein:

the distribution system includes a second hollow rod;

the wiper die assembly is coupled to the second hollow rod; and the lubrication fluid moves through the second hollow rod to the wiper die assembly.

12. The tube bending system of claim 1, wherein:

the wiper die assembly defines a second channel fluidly coupled to the distribution system; and the second channel is configured to direct the lubrication fluid to the outside of the tube.

13. The tube bending system of claim 2, wherein:

the mandrel is comprised in part of bronze; and the lubrication fluid is formulated to limit oxidation of bronze.

14. The tube bending system of claim 1, wherein the lubrication fluid is a synthetic gel.

15. The tube bending system of claim 1, further comprising an extension frame configured to selectively couple to the bending device frame distal the bending die assembly, the bending device frame and the extension frame collectively defining an elongated frame operable to support components spaced from the bending die assembly.

* * * * *